US011333422B2

(12) United States Patent
Almeida et al.

(10) Patent No.: US 11,333,422 B2
(45) Date of Patent: May 17, 2022

(54) AUGMENTED DOOR BIN COOLING USING A DEDICATED AIR DUCT IN A DUAL-EVAPORATOR REFRIGERATOR CONFIGURATION

(71) Applicant: WHIRLPOOL CORPORATION, Benton Harbor, MI (US)

(72) Inventors: Murilo P. Almeida, St. Joseph, MI (US); Bruno Boehringer, Benton Harbor, MI (US); Darci Cavali, St. Joseph, MI (US); Taylor Clark, St. Joseph, MI (US); Marcos Heinzle, Joinville (BR); Benjamin Jimenez, Burns Harbor, IN (US); Dakota Kosek, Benton Harbor, MI (US); Mahalingappa Mulimani, Chennai (IN); Omid Madani, Orlando, FL (US); Navya Mastanaiah, Chennai (IN)

(73) Assignee: Whirlpool Corporation, Benton Harbor, MI (US)

( * ) Notice: Subject to any disclaimer, the term of this patent is extended or adjusted under 35 U.S.C. 154(b) by 197 days.

(21) Appl. No.: 16/049,897

(22) Filed: Jul. 31, 2018

(65) Prior Publication Data

US 2019/0032988 A1 Jan. 31, 2019

Related U.S. Application Data

(60) Provisional application No. 62/539,191, filed on Jul. 31, 2017.

(51) Int. Cl.

| | |
|---|---|
| ***F25D 17/08*** | (2006.01) |
| ***F25D 23/04*** | (2006.01) |
| ***F25D 11/02*** | (2006.01) |
| ***F25D 23/02*** | (2006.01) |

(Continued)

(52) U.S. Cl.

CPC ..... *F25D 17/065* (2013.01); *F25B 13/00* (2013.01); *F25D 17/06* (2013.01); *F25D 17/067* (2013.01); *F25D 17/08* (2013.01); *F25D 11/022* (2013.01); *F25D 23/02* (2013.01); *F25D 23/04* (2013.01); *F25D 2317/061* (2013.01);

(Continued)

(58) Field of Classification Search

CPC ..... F25D 17/065; F25D 17/06; F25D 17/067; F25D 17/08; F25D 23/02; F25D 2317/067; F25D 11/022; F25D 23/04; F25D 2317/062; F25D 2317/0663; F25D 2317/061; F25B 13/00

See application file for complete search history.

(56) References Cited

U.S. PATENT DOCUMENTS

| | | | |
|---|---|---|---|
| 5,666,817 | A | 9/1997 | Schulak et al. |
| 5,979,174 | A | 11/1999 | Kim et al. |

(Continued)

*Primary Examiner* — Lionel Nouketcha
(74) *Attorney, Agent, or Firm* — Price Heneveld LLP

(57) ABSTRACT

A refrigerator includes a fresh food compartment and a mullion adjacent the fresh food compartment. The refrigerator further includes an evaporator compartment defining an exterior and an interior and containing an evaporator. The refrigerator also includes a duct in fluid communication with the evaporator compartment at a first end thereof and in communication with a second end adjacent an opening of the fresh food compartment. The duct has a first portion thereof that extends downwardly from the first end and a second portion extending through the mullion.

19 Claims, 11 Drawing Sheets

(51) Int. Cl.
*F25D 17/06* (2006.01)
*F25B 13/00* (2006.01)

(52) U.S. Cl.
CPC .. *F25D 2317/062* (2013.01); *F25D 2317/067* (2013.01); *F25D 2317/0663* (2013.01)

(56) References Cited

U.S. PATENT DOCUMENTS 6,041,606 A 3/2000 Kim
6,073,458 A 6/2000 Kim
6,401,482 B1 6/2002 Lee et al.
6,983,615 B2 1/2006 Winders et al.
7,127,904 B2 10/2006 Schmid
7,254,960 B2 8/2007 Schmid et al.
8,464,549 B2 * 6/2013 Davis ..... F16J 15/064 62/340
8,707,724 B2 * 4/2014 Kim ..... F25D 17/065 62/340
8,770,682 B2 7/2014 Lee et al.
9,353,983 B2 * 5/2016 Mitchell ..... F25D 23/04
2006/0070385 A1 4/2006 Narayanamurthy et al.
2006/0196217 A1 9/2006 Duarte et al.
2008/0148761 A1 * 6/2008 Venkatakrishnan .. F25D 17/065 62/340
2009/0260371 A1 10/2009 Kuehl et al.
2011/0302950 A1 * 12/2011 Hawkins ..... F25D 17/065 62/344
2012/0266627 A1 10/2012 Lee
2013/0305767 A1 * 11/2013 Lee ..... F25C 5/22 62/340
2015/0285551 A1 10/2015 Aiken et al.
2016/0290704 A1 * 10/2016 Boarman ..... F25B 21/02
2017/0051966 A1 * 2/2017 Powell ..... F25D 23/04
2017/0122469 A1 5/2017 Salehi-Bakhtiar
2017/0122648 A1 * 5/2017 Park ..... F25D 17/062

* cited by examiner

AUGMENTED DOOR BIN COOLING USING A DEDICATED AIR DUCT IN A DUAL-EVAPORATOR REFRIGERATOR CONFIGURATION

CROSS-REFERENCE TO RELATED APPLICATION

This application claims priority to and the benefit under 35 U.S.C. § 119(e) of U.S. Provisional Patent Application No. 62/539,191, filed on Jul. 31, 2017, entitled "AUGMENTED DOOR BIN COOLING USING A DEDICATED AIR DUCT IN A DUAL-EVAPORATOR REFRIGERATOR CONFIGURATION", the entire disclosure of which is hereby incorporated herein by reference.

BACKGROUND

The present device generally relates to a refrigerator having a chilled door compartment. In particular a duct extends from a dedicated fresh food compartment evaporator, through a mullion between refrigerator compartments, and to the door compartment.

Various examples of refrigerators having cooled door compartments exist in which a cool air flow is directed through, for example, a wall of the refrigerator to the door. Such arrangements solve the problem of the forward portions of the refrigerator being generally warmer than the center of the cabinet but many consumers having a preference for storing beverages in the door. In most applications, such cooling is provided in single-evaporator refrigerators, where a common evaporator is used to cool both the freezer and refrigerator, with baffles or fans controlling the air flow to maintain the freezer at a temperature below that of the refrigerator. Even in existing refrigerators with a dedicated fresh food compartment evaporator and a dedicated freezer evaporator, air supplied to a chilled door compartment is taken from the freezer evaporator, which presents certain issues because the desired relative humidity level in the refrigerator exceeds that of the freezer, such that introducing humidity into the freezer airflow will increase frost risk in the freezer. Further, introducing a freezer air supply to the fresh food compartment will mix the relatively warm fresh food compartment and relatively cold freezer airflow such that the intended behavior of each compartment may be considered as adversely affected. Finally, additional energy expenditure would be required to maintain the desired temperature balance of the fresh food compartment contents, where energy margins are generally small and each increment of energy use may be costly. Accordingly, additional improvements may be desired.

SUMMARY

In at least one aspect, a refrigerator includes a fresh food compartment and a mullion adjacent the fresh food compartment. The refrigerator further includes an evaporator compartment defining an exterior and an interior and containing an evaporator. The refrigerator also includes a duct in fluid communication with the evaporator compartment at a first end thereof and in communication with a second end adjacent an opening of the fresh food compartment. The duct has a first portion thereof that extends downwardly from the first end and a second portion extending through the mullion.

In at least another aspect, a cooling system for a refrigerator having a fresh food compartment defining an opening and a mullion adjacent the fresh food compartment and defining a lower side of the fresh food compartment includes an evaporator compartment positioned at least partially within the fresh food compartment remote from the opening and defining an interior. The system further includes a duct in fluid communication with the interior of the evaporator compartment at a first end thereof and in communication with the fresh food compartment on a second end thereof in a position adjacent the opening of the fresh food compartment. The duct has a first portion that extends downwardly from the first end and a second portion extending through the mullion.

In at least another aspect, a refrigerator includes a fresh food compartment defining an opening, a freezer compartment, and a mullion adjacent the fresh food compartment, defining a lower side of the fresh food compartment, and separating the fresh food compartment from the freezer compartment. The refrigerator further includes a first evaporator compartment positioned at least partially within the fresh food compartment remote from the opening and defining an interior and a duct in fluid communication with the interior of the evaporator compartment at a first end thereof and in communication with the fresh food compartment on a second end thereof in a position adjacent the opening, the duct having a first portion thereof that extends downwardly from the first end and a second portion extending through the mullion. The refrigerator further includes a second evaporator compartment (102) positioned adjacent the freezer compartment (14) and containing a second evaporator (106). The second evaporator compartment is in fluid communication with the freezer compartment (14).

These and other features, advantages, and objects of the present device will be further understood and appreciated by those skilled in the art upon studying the following specification, claims, and appended drawings.

DETAILED DESCRIPTION OF EMBODIMENTS

Figure 1:
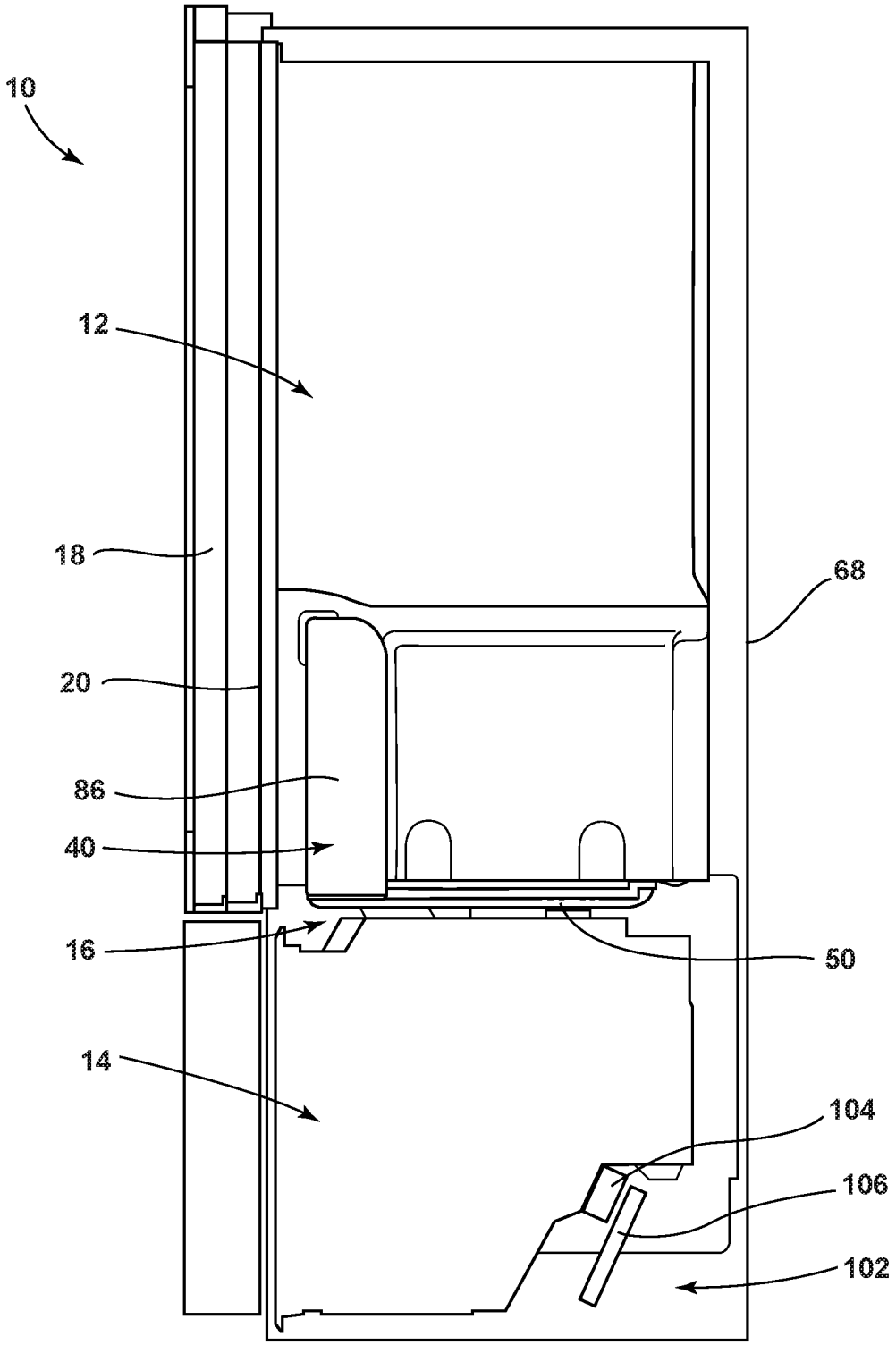
FIG. 1 is a right side elevation view of a refrigerator according to an aspect of the disclosure.
Figure 2:
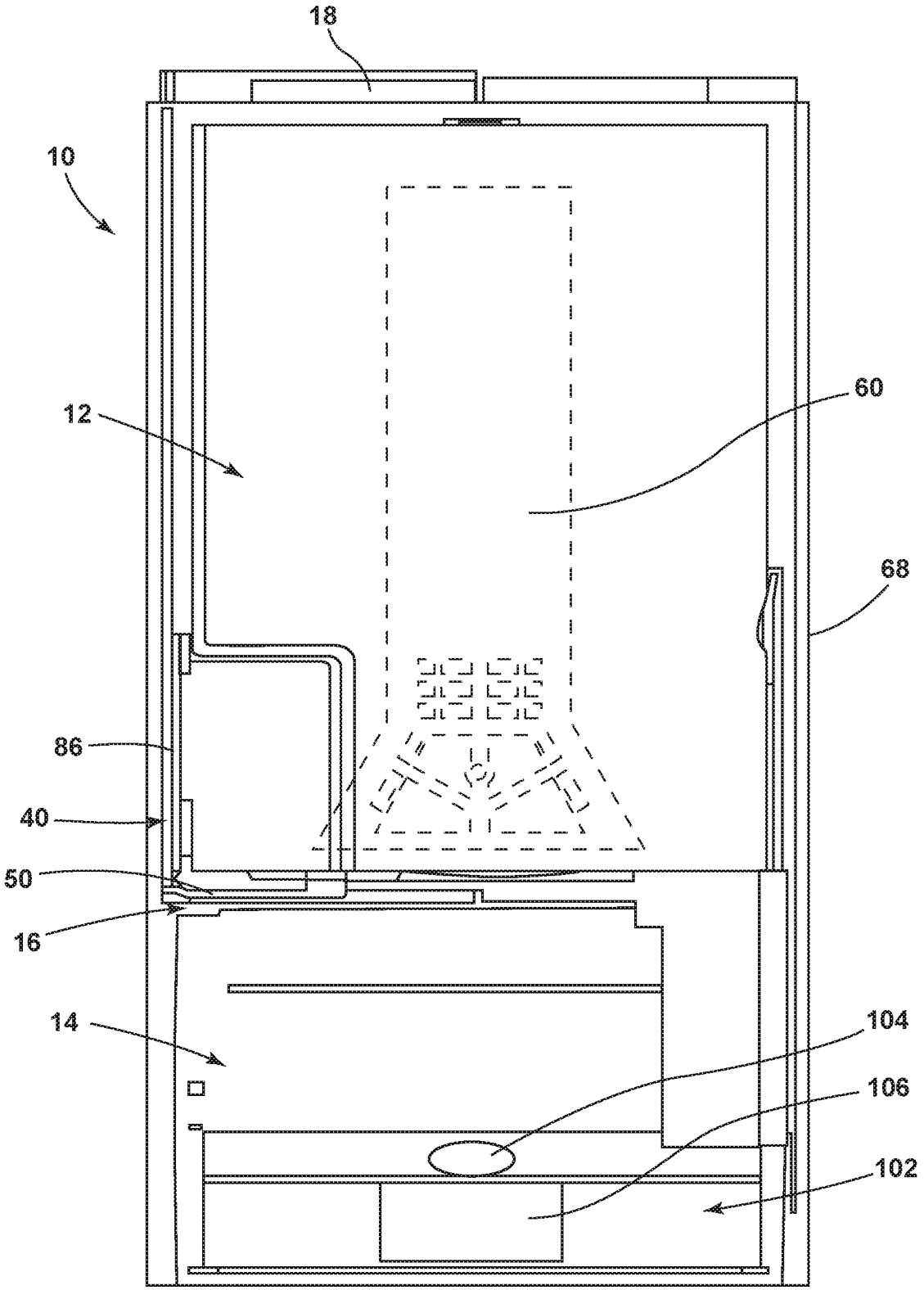
FIG. 2 is a back view of the refrigerator of FIG. 1.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIGS. 1-12, reference numeral 10 generally designates a refrigerator. Refrigerator 10 includes a fresh food compartment 12 and a freezer compartment 14 separated by a mullion 16 extending therebetween. A door 18 at least partially encloses an opening 20 to the fresh food compartment 12 when in a closed position. The door 18 defines a door dyke 22 extending inwardly within the fresh food compartment 12 around a periphery 24 of the door 18. A door compartment 26 is positioned along the door 18 with at least a portion of the dyke 22 adjacent to a portion of the compartment 26. A vent opening 28 extends through the dyke 22 and into the door compartment 26. An evaporator compartment 30 is positioned at least partially within the fresh food compartment 12 and defines an exterior 32 and an interior 34. The evaporator compartment 30 contains an evaporator 36 (shown schematically in FIG. 7) and a fan 38 for drawing chilled air away from the evaporator 36. The refrigerator 10 further includes a duct 40 in fluid communication with the evaporator compartment 30 adjacent the fan 38 at a first end 42 and in communication with the vent opening 28 at a second end 44 thereof such that the duct 40 directs chilled air from the evaporator compartment 30 to the door compartment 26. The duct 40 has a first portion 46 that extends downwardly (in vertical direction 48) from the first end 42 along a portion of the exterior 32 of the evaporator compartment 30 and a second portion 50 extending through the mullion 16.

In the illustrated embodiment, the door 18 is configured as a right door 18 in a French-door refrigerator arrangement, in which a left door is also included with each of the right door 18 and the left door covering approximately half of the opening 20 to fresh food compartment 12, with each door being hingedly connected about or adjacent a corresponding outer edge of a housing 68 of refrigerator 10. In the depicted arrangement, as particularly shown in FIG. 4, the door compartment 26 is positioned along a lower portion of the right-side door 18 such that it is surrounded by opposing sides 70 and 72 of dyke 22 and is adjacent lower side 78 of dyke 22. Door compartment 26 extends only partially upward along door 18 such that additional bins 74 can also be positioned along door 18. Further, compartment 26 can, as illustrated, be an enclosed compartment accessible through a sub-door 76 facing inwardly on door compartment 26 so that door compartment 26 can be accessed by a user when door 18 is open. Additionally or alternatively, door 18 can be in a door-in-door configuration with an outer door (not shown) positioned opposite door compartment 26 and bins 74 so that door compartment 26 can be accessed from outside of refrigerator 10.

In this manner, duct 40 can provide a direct cool air supply of chilled air from the evaporator compartment 30 to the door compartment 26. In one example, the cool air supply can make door compartment 26 useable as a "beverage zone", such that the compartment 26 becomes colder than the center of the fresh food compartment 12 interior. The fan 38 within evaporator compartment 30 accelerates air from upstream as it passes through the evaporator 36 and is cooled. Downstream from fan 38, the chilled air is distributed through a network of flow pathways, as discussed further below, to the interior of the fresh food compartment 12 in general and to an enclosed pantry or crisper (not shown) typically within a lower portion of fresh food compartment 12 and which may be partially isolated form the chilled air flow by way of a damper or the like that can restrict the flow of chilled air thereinto to intentionally maintain the pantry temperature above the remaining portion of the fresh food compartment 12.

In general, the door 18 of the refrigerator is susceptible to increased warming relative to the center of the fresh food compartment 12 interior due to its proximity to the exterior of the refrigerator 10 and its distance from the primary outlets of chilled air from evaporator compartment 30. However, because the door 18 is conveniently sized for beverage storage, and is generally easily accessible, additional cooling of at least a portion of door 18 may be desired to maintain perishable beverages (such as dairy products or the like) at a lower temperature, or to otherwise more quickly cool and maintain a low temperature of beverages. In this manner duct 40 has no damper such that it receives flow concurrently with the rest of the fresh food compartment 12 to maintain door compartment 26 at a lower temperature than would otherwise be obtainable.

Figure 3:
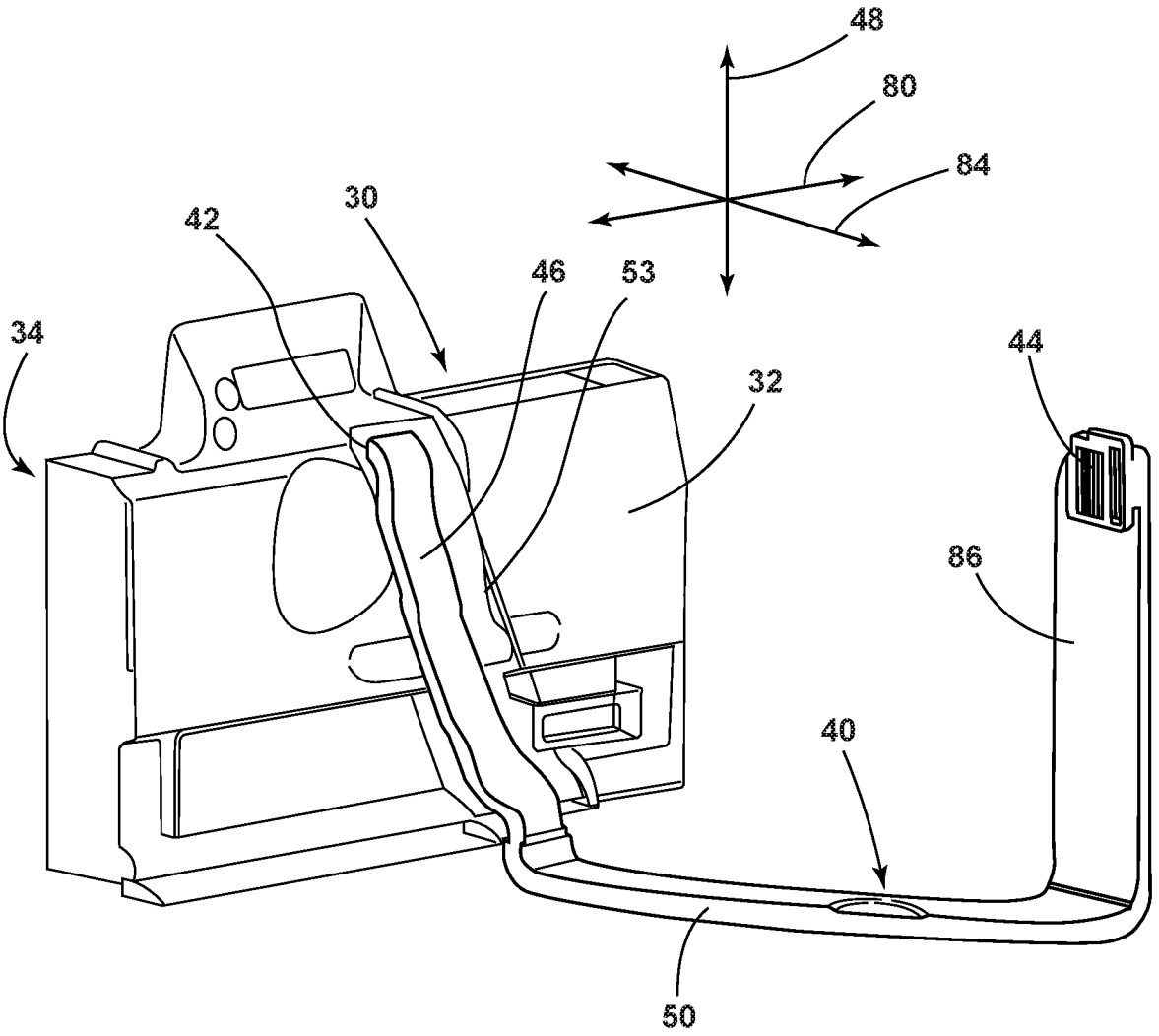
FIG. 3 is a front perspective view of a duct extending from an evaporator compartment to an outlet positionable in a side wall of a compartment in the refrigerator of FIG. 1.
Figure 7:
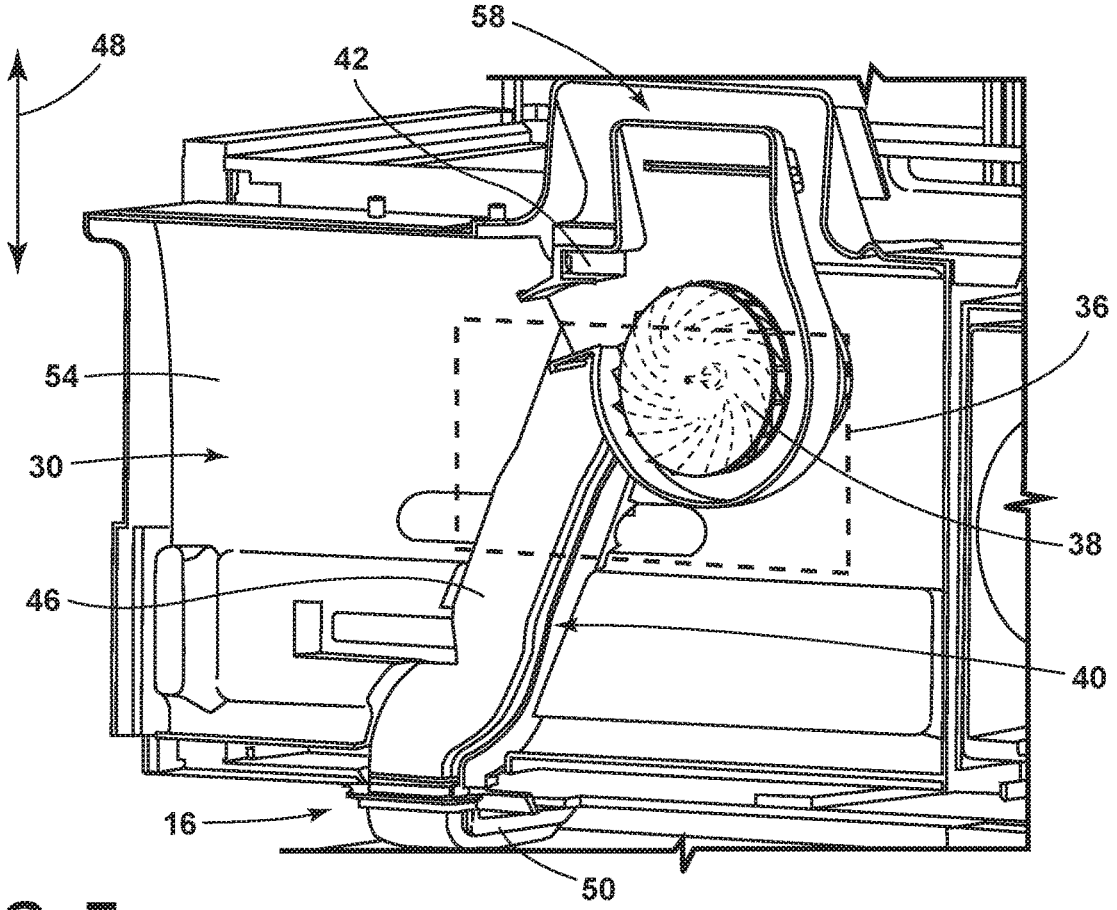
FIG. 7 is an back perspective interior view of the refrigerator, including portions within a cosmetic cover of the evaporator compartment and showing routing of the duct within the cover.
Figure 8:
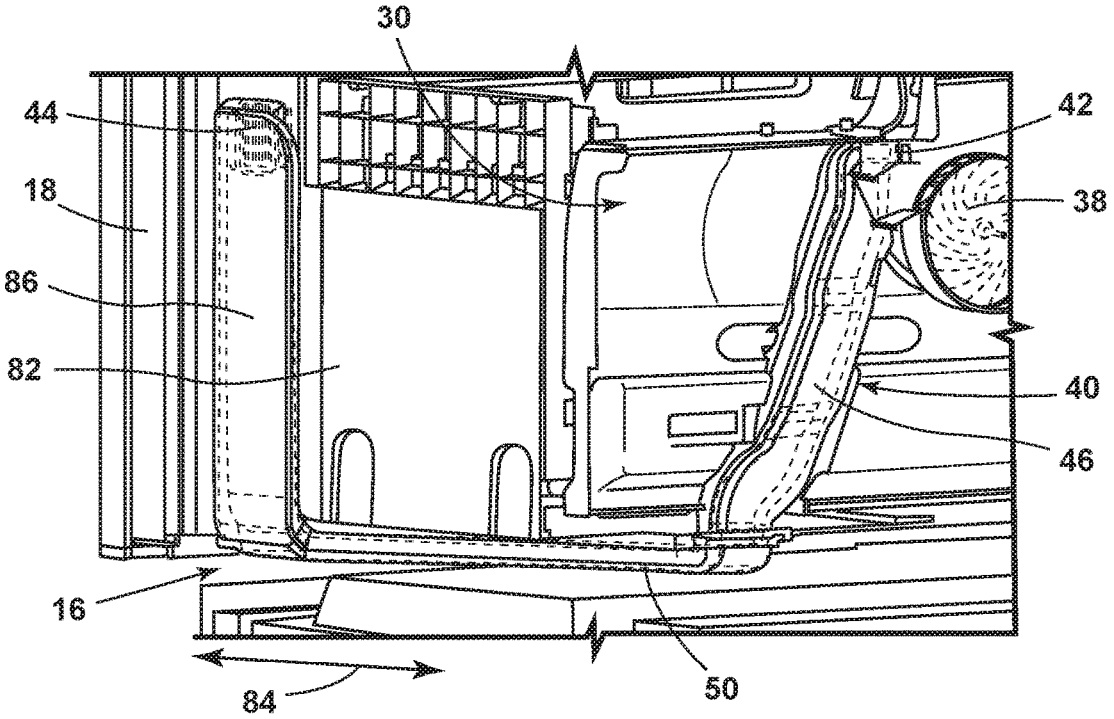
FIG. 8 is a side perspective interior view showing the interior of the refrigerator, including portions within the cosmetic cover of the evaporator compartment and showing routing of the duct within the cover and between compartments of the refrigerator.
Figure 9:
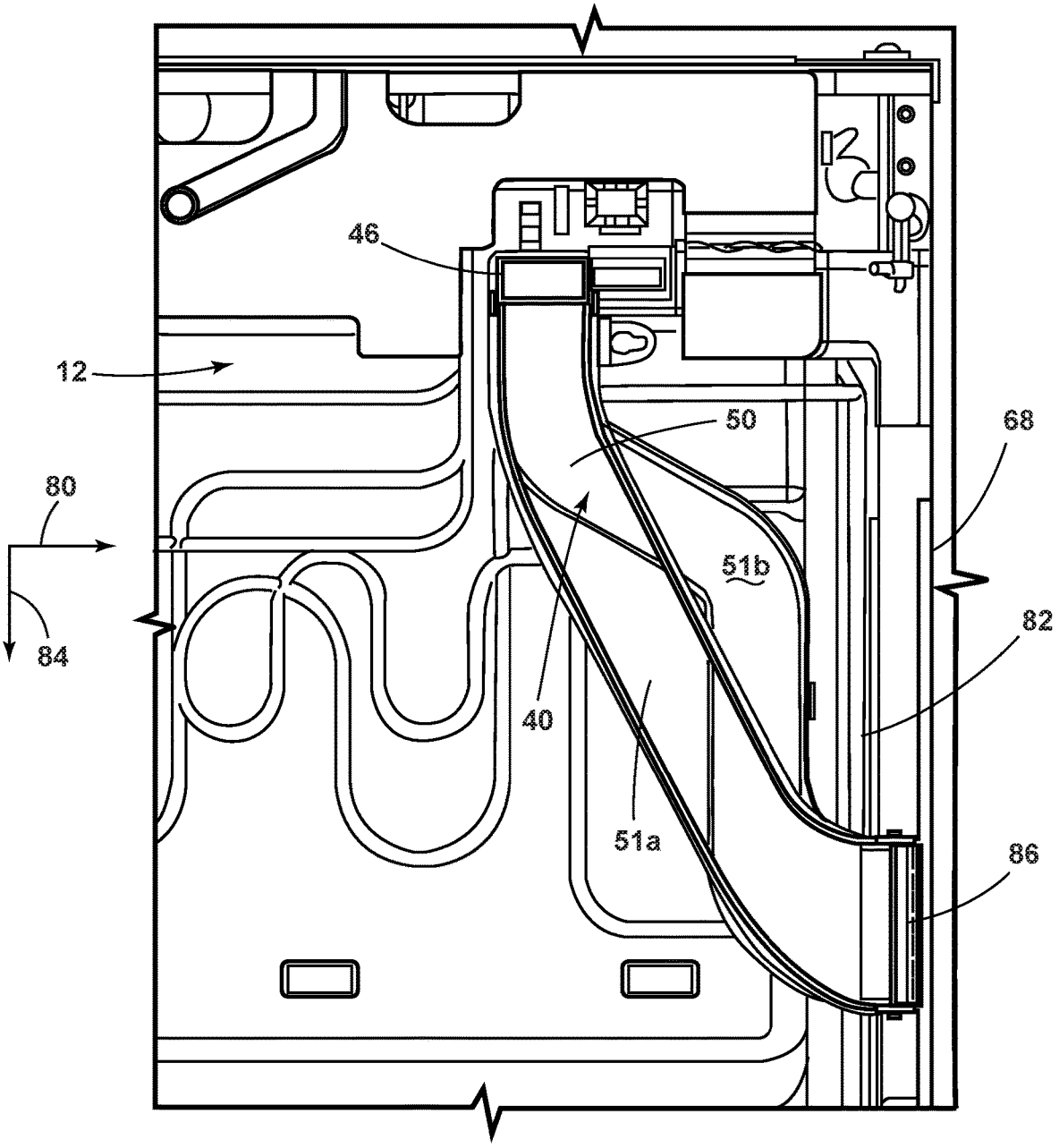
FIG. 9 is a top, cross-sectional interior view of the refrigerator showing alternate paths for the duct through a mullion of the refrigerator.
Figure 10:
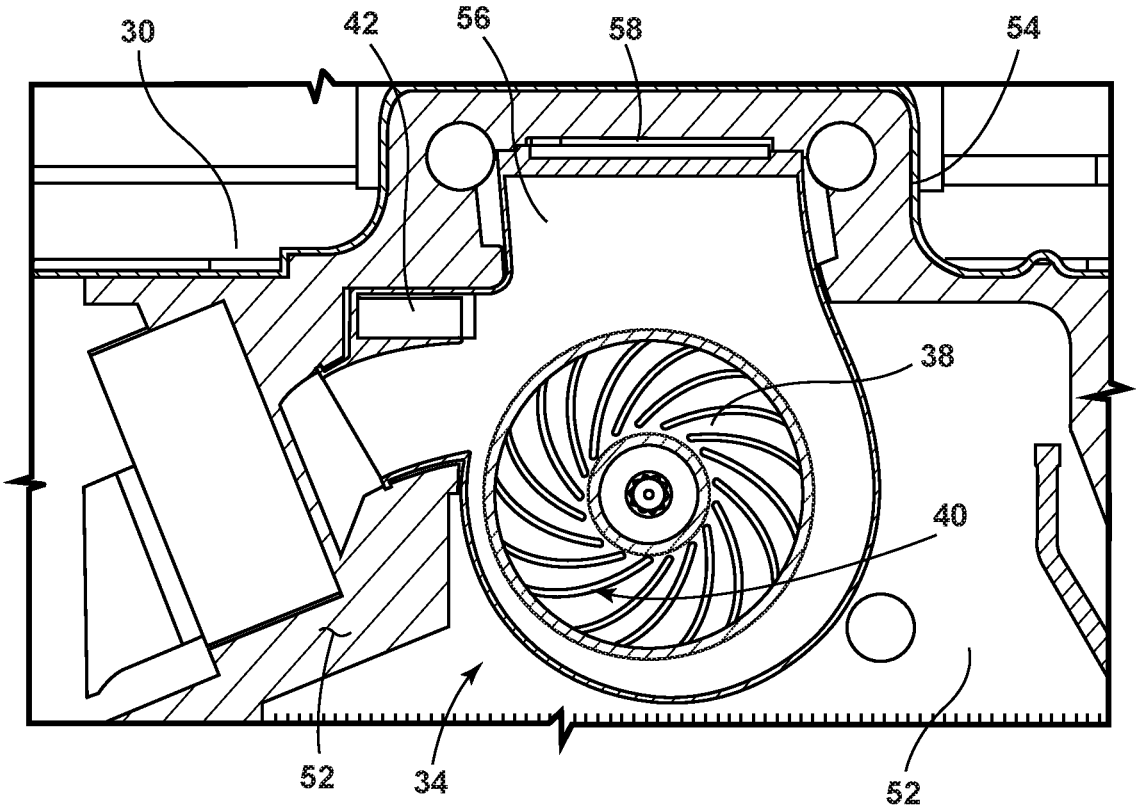
FIG. 10 is a cross-section view of the evaporator compartment, including the fan therein and the chilled air outlets from the compartment associated with the fan.
Figure 11:
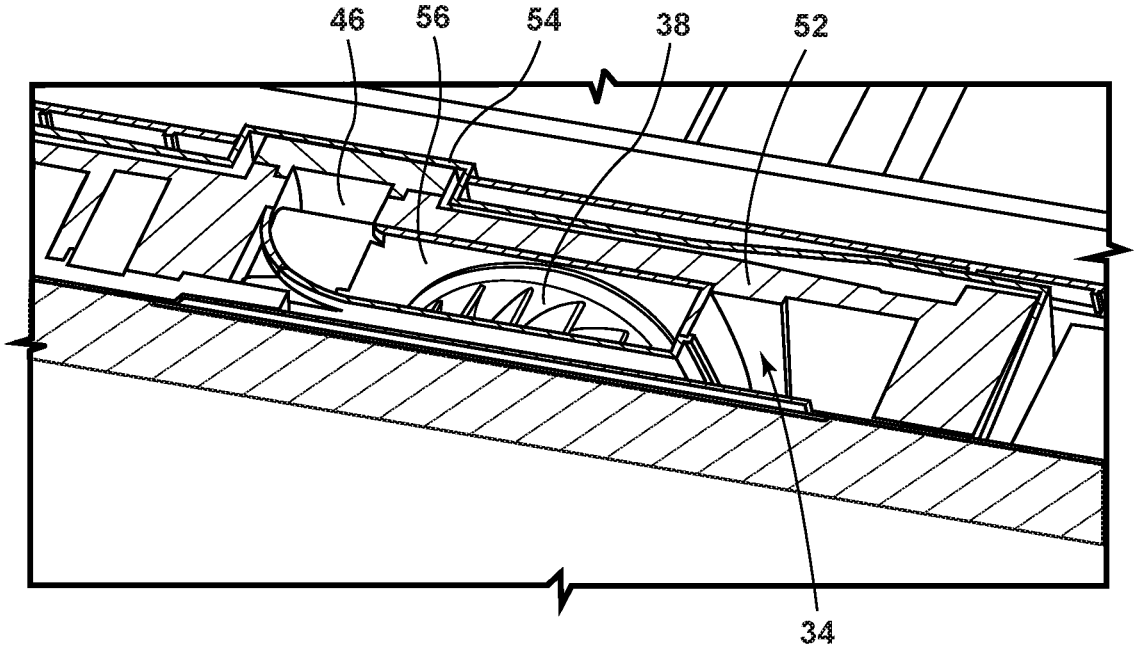
FIG. 11 is a perspective cross-section view of the evaporator compartment further showing the fan therein and the chilled air outlets.

As shown in FIG. 3, evaporator compartment 30 is generally defined and separated from fresh food compartment 12 by a housing 68 (FIG. 1) that defines the interior 34 and exterior 32 surfaces thereof. As also shown, fan 38 (FIG. 7) is mounted within a shroud 56 (FIG. 10) within housing 68. Turning to FIGS. 7 and 8, a generally cosmetic outer cover 54 is positioned on the exterior 32 of housing 52 (FIG. 10) to provide a finished appearance for evaporator compartment 30. Both housing 52 and cover 54 include a primary outlet channel 58 therethrough that directs air from fan 38 into the fresh food compartment 12. An air tower 60 (FIG. 2) that upward from evaporator compartment 30 along the rear wall of the fresh food compartment 12 and provides the primary flow of chilled air therefor. As shown in FIGS. 9 and 10, the first end 42 of duct is in communication with the interior 34 of the evaporator compartment 30 such that a portion of the chilled air is forced into duct 40 by fan 38. Returning to FIG. 3, it can be seen that the first portion 46 of duct 40 extends downwardly in vertical direction 48 along the exterior 32 of evaporator compartment 30, which, as shown in FIGS. 7 and 8 positions first portion 46 of duct 40 inside cover 54 so that duct 40 is concealed from view. In various embodiments, housing 52 can be adapted to accommodate the position and/or packaging of first portion 46 of duct 40 in the often limited space between housing 52 and cover 54. In the example shown, housing 52 can define a recess 53 therein that allows first portion 46 to be set into housing relative to adjacent portions of the exterior surface 32 (and, further, potentially relative to adjacent portions of interior surface 34). In other examples, portions (such as inner or outer portions) of first portion 46 can be incorporated into housing 52, such as by way of a similar recess and/or external ribs, with a corresponding portion being assembled therewith to define the enclosed first portion 46 of duct 40. Similar accommodations for or incorporations of duct 40 can also be made by or into cover 54, including by positioning a similar recess therein or incorporating portions of duct 40 directly into cover 54. It is further noted that aspects the routing of duct 40 between housing 52 and cover 54 and/or the incorporation of a portion of duct 40 directly into housing 52 discussed herein can be implemented in connection with alternative routing paths 40 for duct 40, including but not limited to, horizontal extension of a duct from the corresponding air inlet thereof to the side wall of the refrigerator compartment.

Figure 6:
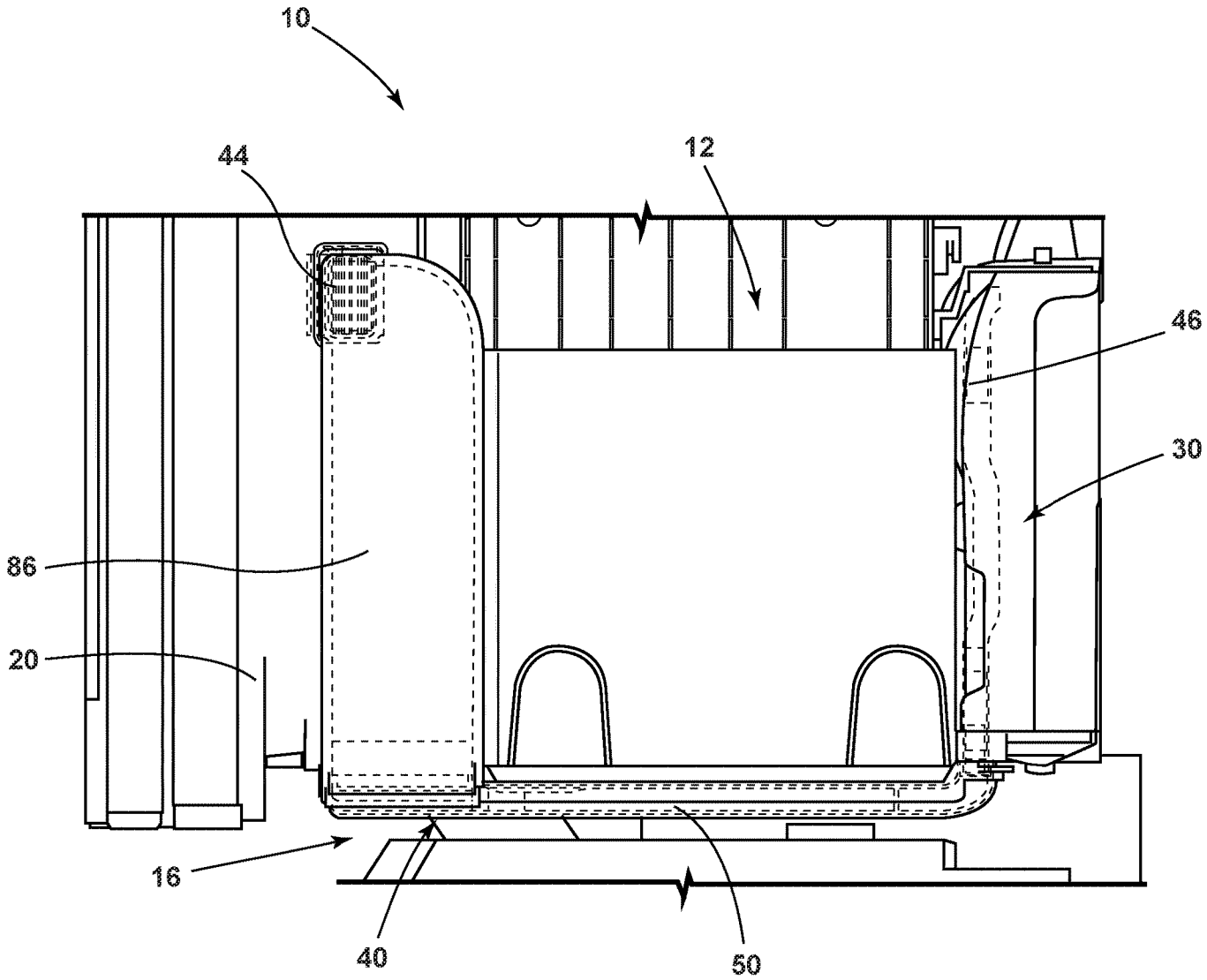
FIG. 6 is a right side detail view of internal components of the refrigerator, including the duct.

Continuing with reference to FIG. 3, it can be seen that the first portion 46 of duct 40 extends downwardly below evaporator compartment 30, which, as shown in FIGS. 6-8, positions second portion 50 of duct 40 within the mullion 16 between the fresh food compartment 12 and the freezer compartment 14 to extend toward the door 20. As shown in FIG. 9, the second portion 50 of duct 40 extends outwardly in the lateral direction 80 toward wall 82 and in the forward direction 84 toward door 18. The illustration in FIG. 9 depicts alternate paths that second portion 50 can take, including a serpentine path 51*a* that includes majority outward extension in lateral direction 80, followed by majority forward extension along direction 84 within mullion 16. Subsequently, serpentine path 51*a* extends slightly outwardly to reach the space between the side wall 82 of fresh food compartment 12 and the refrigerator housing 68 for positioning of third portion 86. Alternatively, second portion 50 can extend along a generally straight diagonal path 51*b* that simultaneously extends toward wall 82 and toward door 18. The more direct route taken by diagonal path 51*b* may provide improved airflow through second portion 50 compared to the serpentine path 51*a*. Serpentine path 51*a*, however, may provide advantages with respect to fit within mullion 16 including around any other features or elements therein.

Positioning the second portion 50 of the duct 40 within the mullion 16 between the fresh food compartment 12 and the freezer 14 may make the presence of duct 40 easier to hide or visually obscure within the fresh food compartment 12, particularly along the cover 54 of evaporator compartment 30 and/or the intersection between cover 54 and the adjacent side wall 82, whereas a duct routed horizontally from fan 38 through cover 54 and wall 82 may require protrusions in one or more of the same to allow adequate room for a duct with desired air flow characteristics. Such protrusions may not only be visible to the consumer, but may also interfere with mounting or other positioning of bins, shelves, or other components within fresh food compartment 12. Further, the positioning within mullion 16 provides a cooler environment for routing of duct 40, as mullion 16 is between two cooled environments (including freezer 14, which is generally cooled to a temperature below that of fresh food compartment 12. Comparatively, the location between side wall 82 and the refrigerator housing 68 is adjacent the warmer ambient air on the other side of housing 68. As the presence of duct 40 replaces insulation material regardless of its position, the exposure to warmer temperatures by positioning of duct 40 along housing 68 can be reduced or minimized to prevent warming of the chilled air passing therethrough. Further, the required removal of insulation surrounding duct 40 is preferred within mullion 16 compared to adjacent housing 68 to reduce the loss of heat therethrough. As can be appreciated, the third portion 86 of duct 40 necessarily extends adjacent housing 68 to some extent, but such an extent is less compared to complete routing adjacent wall 82. Further, the heat gained through housing 68 can be minimized by the heat removed through mullion 16. In some instances, additional heat gained at that point through housing 68 may actually be advantageous to prevent frost within third portion 86 or within door compartment 26. Accordingly, a layer of foil 88 may be positioned between housing 68 and third portion 86 in respective contact with each to promote heat gain through third portion 86. To further prevent frost accumulation in or on duct 40, particularly along second portion 50 thereof, due to cooling of the air flow therein due to the lower temperature of freezer compartment 62, a heating element 89*a*,89*b* can be positioned in the mullion 16 between the liner of the freezer 14 and the second portion 50 of duct. As shown, the positioning of heating element 89*a*,89*b* can correspond with the particular path 51*a* or 51*b* of second portion 50 to appropriately align with duct 40. Such a heating element can be an electric heating element employing, for example, resistive elements, a Peltier device, or the like. Heating element 89*a*,89*b* can also be configured for heating of duct 40 by conduction (i.e. with heating element 89*a*,89*b* in contact with duct 40), or by convection (i.e. with heating element 89*a*,89*b* heating the air adjacent duct 40 to prevent overcooling thereof).

Figure 4:
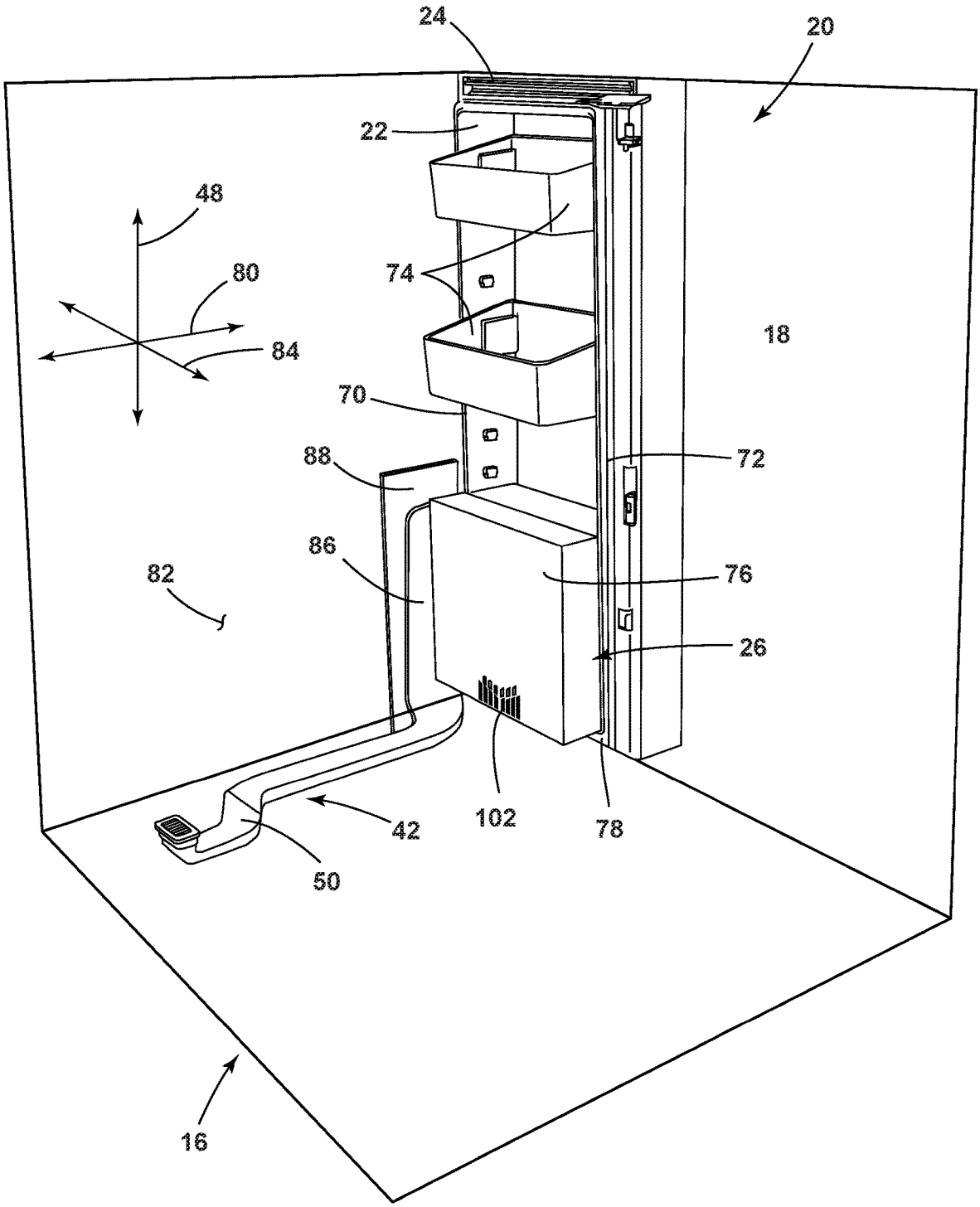
FIG. 4 is a partial interior view of the refrigerator of FIG. 1 showing routing of the duct to a compartment in a door of the refrigerator.
Figure 5:
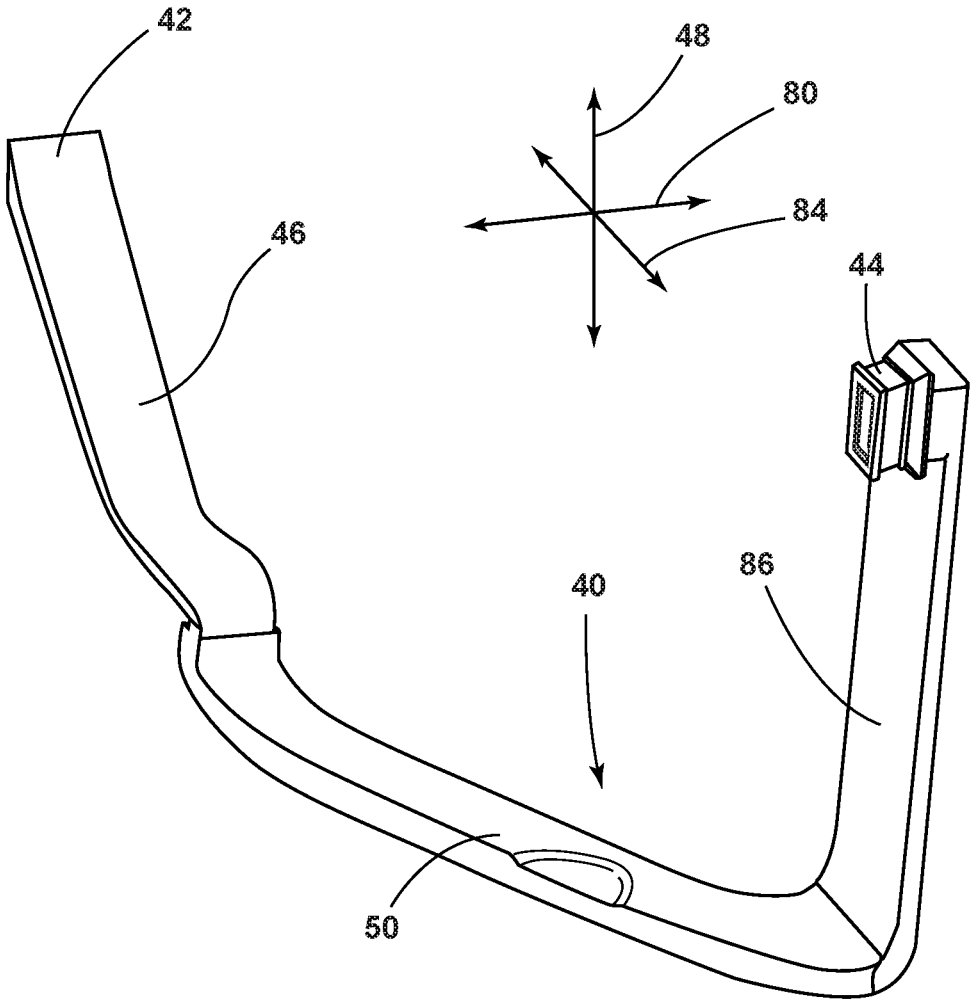
FIG. 5 is a perspective view of the duct.
Figure 12:
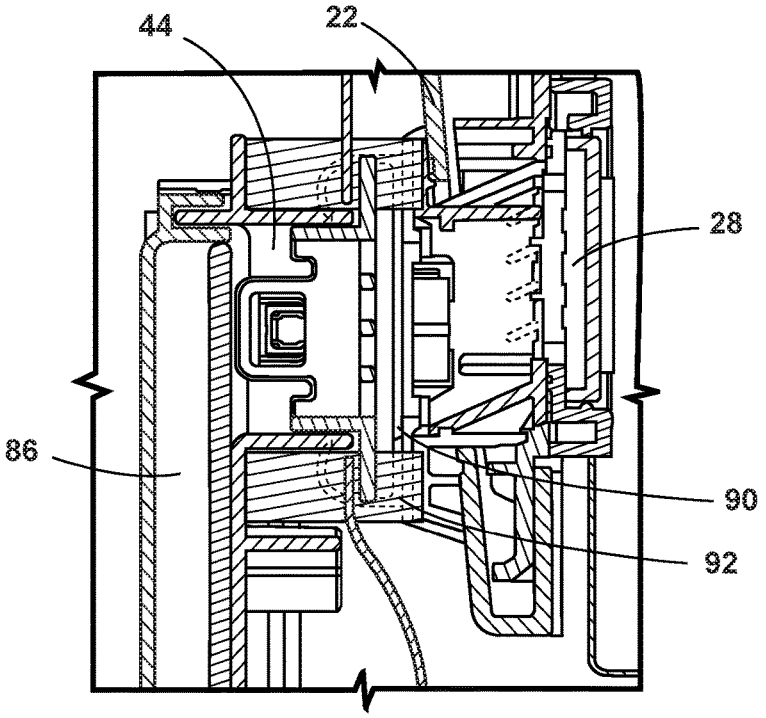
FIG. 12 is a cross section view of a wall of the refrigerator showing fluid connection of the duct with the door compartment.
Figure 13:
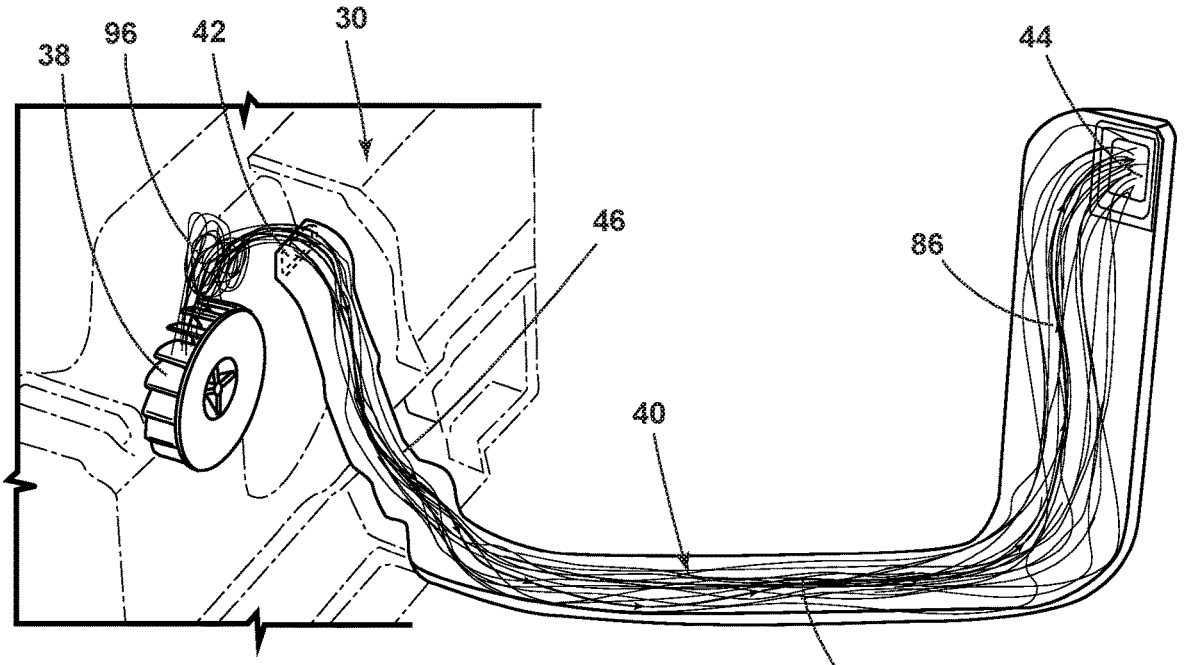
FIG. 13 is a schematic diagram showing air flow through the duct.
Figure 14:
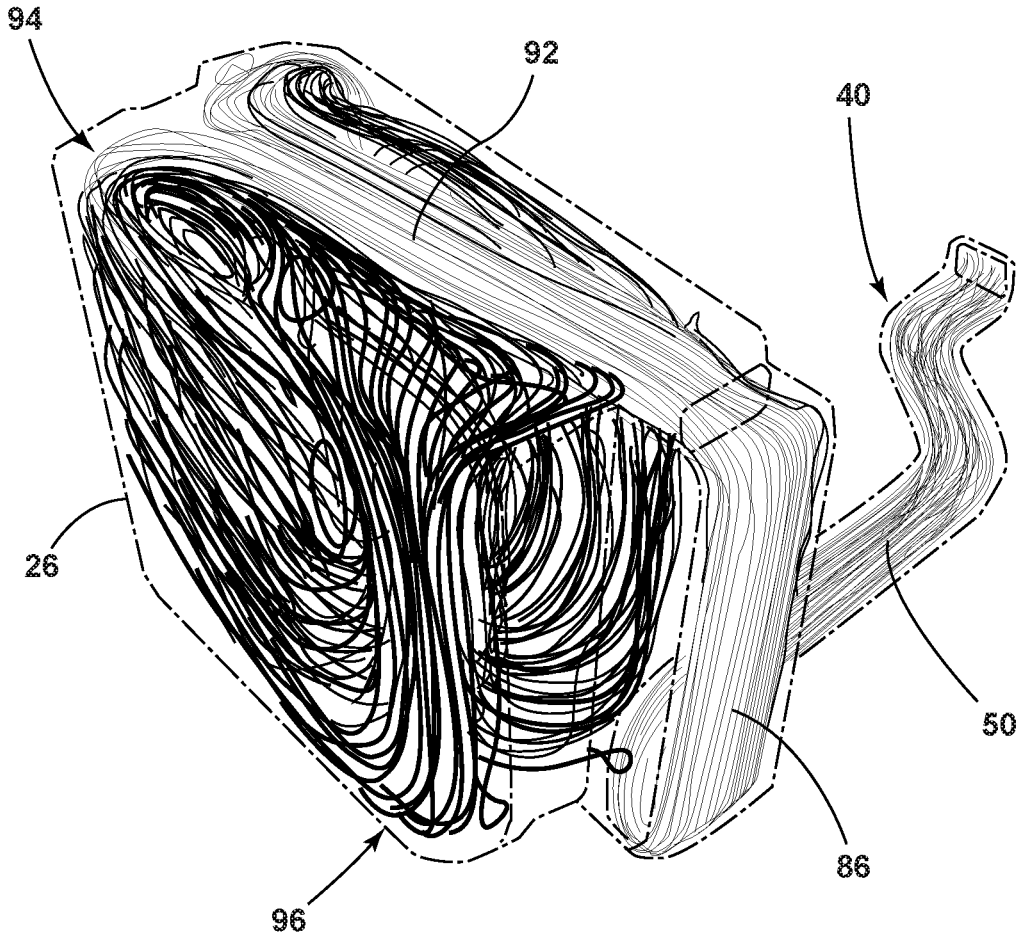
FIG. 14 is a schematic diagram showing air flow out of the duct and within the door compartment.

To promote effective cycling of the air flow provided by duct 40 through door compartment 26 and back through fresh food compartment 12 to evaporator compartment 30, the second end 44 of duct 40 and the corresponding outlet 90 in wall 82 that aligns with second end 44, as well as the vent opening 28 in dyke 22 can be positioned vertically toward an upper portion 94 of door compartment 26, as shown in FIG. 12. To that end, third portion 86 of duct 40 extends upwardly in vertical direction 48 between wall 82 and housing 68 for the desired position of second end 44. As illustrated, the third portion 86 of duct 40 may be wider in direction 84 and narrower in direction 80 to maintain a desired air flow therethrough while fitting within the available space. As shown in FIG. 12, second end 44 of duct 40 aligns with the above-mentioned outlet 90 in wall 82 with wall 82 extending outwardly therefrom. In this manner, a gasket 92 is attached with dyke 22 within vent opening 28 to seal against wall 82 in the area surrounding second end 44 to direct air flowing out of duct 40 through dyke 22 and onto door compartment 26. FIG. 13 depicts the general air flow path 96 from fan 38 through duct 40 and out of second end 44. The above-described positioning of second end 44 along wall 82 and the accompanying positioning of vent opening 28 toward the upper portion 94 of door compartment 26 is such that the chilled air, which may be comparatively cooler than existing air within door compartment 26 enters door compartment 26 in upper portion 94, where the pressure and velocity of the air flow 96 causes the chilled air to extend across upper portion 94 away from vent opening 28, as shown in FIG. 14. The greater density of the chilled air flowing from vent opening 28 causes the air flow 96 to also flow downwardly, as it extends across upper portion 94 (some of which is redirected back toward vent opening 28 by the internal geometry of door compartment 26. This effect in the air flow 96 causes the chilled air to air circulate through door compartment 26 to cool door compartment 26 before settling in the lower portion 98 of door compartment 26. As shown in FIG. 4, a plurality of vents 102 are positioned along door compartment 26 within the lower portion 98 thereof, where the air can entering the fresh food compartment 12 to join the airflow therein for recovery through return ducting within fresh food compartment 12 to be continuously reused in the system.

When the refrigerator 10 is assembled, a foam flow is injected into the housing 68, to fill the area inside housing 68 and outside of the respective fresh food 12 compartment and freezer 14 to insulate refrigerator 10. This foam also fills mullion 16 separating fresh food compartment 12 and freezer 14 such that it expands and surrounds duct 40. To compensate for the pressure of the expanding foam, duct 40 may have internal structural supports to avoid being crushed during the foaming process.

The present configuration of duct 40 is particularly useful in an arrangement, as shown in FIG. 1, wherein the evaporator compartment 30 is only in communication with fresh food compartment 12 and is not used for freezer 14. In this manner, a second evaporator compartment 102 is present in connection with freezer 14 and includes a dedicated fan 104 and evaporator 106 for use in cooling freezer 14 at a relatively lower temperature than fresh food compartment 12. In a general "dual-evaporator" arrangement, the desired relative humidity level in the fresh food compartment 12 exceeds that of the freezer 14, such that providing air to door compartment 26 from freezer 14 would introduce humidity into the freezer 14 airflow, increasing the frost risk in the freezer 14. Such an arrangement would mix the relatively warm air from the fresh food compartment 12 and relatively cold air from the freezer such that the intended behavior of each compartment could be considered as performing in an undesired manner. Still further, additional energy expenditure in such an arrangement would be required to maintain the desired temperature balance for the contents of the fresh food compartment 12, where energy margins may be small and each increment of energy use may be costly. Accordingly, the provision, in the present arrangement, of air from the evaporator compartment 30 dedicated to fresh food compartment 12 to door compartment 26, where such air then enters the fresh food compartment 12 to cool any additional items therein (which further warms the air flow) for circulation back to evaporator compartment 30 may be advantageous.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator, comprising:

an outer housing;

a liner received inside the outer housing and defining a fresh food compartment and an opening thereof to an exterior of the outer housing;

a mullion adjacent the fresh food compartment and defining a lower side of the fresh food compartment;

an evaporator compartment positioned at least partially within the fresh food compartment remote from the opening and defining an interior;

a duct in fluid communication with the interior of the evaporator compartment at a first end thereof and terminating at a second end of the duct that is in communication with a duct opening that extends through the liner in a position adjacent the opening, the duct having a first portion thereof that extends downwardly from the first end, a second portion extending through the mullion, and a third portion extending vertically upward aligned with the duct opening; and a door at least partially enclosing the opening to the fresh food compartment when in a closed position and having a door compartment extending from a lower side of the door only partially upward along a lower portion of the door through less than half a total height of the door, the door compartment defining an upper portion and a lower portion and having a vent opening positioned adjacent the top portion of the door compartment, the vent opening being horizontally aligned with and in communication with the second end of the duct to direct air into the door compartment, without any portion of the duct being positioned within the door and with only the duct opening contacting the door, the lower portion of the door compartment being open to the fresh food compartment via a plurality of vents on a surface of the door compartment that faces inward with respect to the fresh food compartment when the door is in the closed position.

2. The refrigerator of claim 1, wherein:

the evaporator compartment further defines an exterior opposite the interior; and the first portion of the duct extends downwardly from the first end along a portion of the exterior of the evaporator compartment.

3. The refrigerator of claim 2, wherein:

the door defines a door dyke extending inwardly within the fresh food compartment around a periphery of the door; and the door compartment is positioned along the door with at least a portion of the dyke adjacent to a portion of the door compartment, the vent opening extending through the dyke and into the door compartment.

4. The refrigerator of claim 3, wherein:

the liner defines an interior wall portion extending away from the mullion with the dyke of the door adjacent thereto, an outlet being defined within the interior wall portion of the liner; and the third portion of the duct extends upwardly from the second portion in a direction away from the mullion, the third portion extending to the opening such that the opening surrounds the second end of the duct.

5. The refrigerator of claim 4, wherein the second portion of the duct extends through the mullion along a path toward the door and simultaneously toward the interior wall of the liner.

6. The refrigerator of claim 1, wherein the evaporator compartment is in communication with the fresh food compartment by the vent opening such that the duct directs chilled air from the evaporator compartment to the door compartment.

7. The refrigerator of claim 1, further including a freezer compartment separated from the fresh food compartment by the mullion.

8. The refrigerator of claim 7, wherein the mullion defines a volume between and separated from each of the freezer compartment and the fresh food compartment.

9. The refrigerator of claim 7, wherein the evaporator compartment is a first evaporator compartment in communication with the fresh food compartment only and includes a first evaporator therein.

10. The refrigerator of claim 9, further including:

a second evaporator compartment positioned adjacent the freezer compartment and containing a second evaporator, the second evaporator compartment being in fluid communication with the freezer compartment.

11. The refrigerator of claim 1, wherein:

the evaporator compartment contains a fan for drawing chilled air away from the evaporator; and the first end of the duct is positioned adjacent the fan.

12. The refrigerator of claim 1, further including an air tower within the fresh food compartment in communication with the evaporator compartment for providing chilled air from the evaporator compartment to the fresh food compartment.

13. The refrigerator of claim 1, wherein the door compartment is configurable in a closed condition, wherein the door compartment is enclosed except for the vent opening positioned adjacent the top portion of the door compartment and the plurality of vents on the surface of the compartment facing inward with respect to the fresh food compartment.

14. A refrigerator, comprising:

a fresh food compartment defining an opening to the fresh food compartment, an interior wall along a portion of the fresh food compartment and having a portion adjacent the opening;

a mullion adjacent the fresh food compartment and defining a lower side of the fresh food compartment, the interior wall extending away from the mullion;

an evaporator compartment positioned at least partially within the fresh food compartment remote from the opening and defining an interior;

a duct in fluid communication with the interior of the evaporator compartment at a first end thereof and in communication with the fresh food compartment on a second end thereof in a position adjacent the opening, the duct having a first portion thereof that extends downwardly from the first end, a second portion extending through the mullion, and third portion further extending vertically upward adjacent the opening to an outlet in the interior wall, the outlet surrounding the second end of the duct; and a door at least partially enclosing the opening to the fresh food compartment when in a closed position and having a door compartment extending from a lower side of the door only partially upward along a lower portion of the door through less than half of a total height of the door, the door compartment defining an upper portion and a lower portion and having a vent opening positioned adjacent the top portion of the door compartment, the vent opening being horizontally aligned with and in communication with the second end of the duct to direct air into the door compartment, without any portion of the duct being positioned within the door and with only the duct opening contacting the door, the lower portion of the door compartment being open to the fresh food compartment via a plurality of openings on a surface of the door compartment facing inward with respect to the fresh food compartment when the door is in the closed position.

15. The refrigerator of claim 14, further comprising a door at least partially enclosing the opening to the fresh food compartment when in a closed position, the door defining a door dyke extending inwardly within the fresh food compartment around a periphery of the door, a vent opening in communication with the second end of the duct extending horizontally through the door dyke.

16. The refrigerator of claim 15, wherein the door further includes a door compartment positioned along the door and partially defined by the door dyke, the door compartment defining an upper portion and a lower portion, the vent opening positioned adjacent the top portion of the door compartment, the lower portion of the door compartment being open to the fresh food compartment.

17. The refrigerator of claim 16, wherein the door compartment is configurable in a closed condition, wherein the door compartment is enclosed except for the vent opening positioned adjacent the top portion of the door compartment; and at least one lower vent positioned within the lower portion of the door compartment and oriented toward a rear of the fresh food compartment such that the lower portion of the door compartment is open to the fresh food compartment.

18. The refrigerator of claim 14, wherein:

the second portion of the duct has a first width and a first thickness;

the third portion of the duct has a second width and a second thickness;

the first thickness is greater than the second thickness; and the second width is greater than the first width.

19. A refrigerator, comprising:

a fresh food compartment defining an opening and an interior wall having a portion adjacent the opening;

a mullion adjacent the fresh food compartment and defining a lower side of the fresh food compartment, the interior wall extending away from the mullion;

an evaporator compartment positioned at least partially within the fresh food compartment remote from the opening and defining an interior;

a duct in fluid communication with the interior of the evaporator compartment at a first end thereof and in communication with the fresh food compartment on a second end of the duct that is in a position adjacent the opening, the duct having a first portion thereof that extends downwardly from the first end, a second portion extending through the mullion, and a third portion further extending vertically upward adjacent the opening to an outlet in the interior wall, the outlet surrounding the second end of the duct; and a door at least partially enclosing the opening to the fresh food compartment when in a closed position and having a door compartment extending from a lower side of the door only partially upward along a lower portion of the door through less than half of a total height of the door, the door compartment defining an upper portion and a lower portion and having a vent opening positioned adjacent the top portion of the door compartment, the vent opening being horizontally aligned with and in communication with the second end of the duct to direct air into the door compartment, without any portion of the duct being positioned within the door and with only the duct opening contacting the door, the lower portion of the door compartment being open to the fresh food compartment.

* * * * *